US009903605B2

(12) United States Patent
Nilsson

(10) Patent No.: US 9,903,605 B2
(45) Date of Patent: Feb. 27, 2018

(54) DEVICE AND METHOD FOR CONTROLLING A SUPPLY AIR FLOW AT AN AIR TREATMENT SYSTEM

(71) Applicant: FLÄKT WOODS AB, Jönköping (SE)

(72) Inventor: Per Nilsson, Tenhult (SE)

(73) Assignee: FLÄKT WOODS AB, Jönköping (SE)

( * ) Notice: Subject to any disclaimer, the term of this patent is extended or adjusted under 35 U.S.C. 154(b) by 0 days.

(21) Appl. No.: 15/128,146

(22) PCT Filed: Feb. 11, 2015

(86) PCT No.: PCT/SE2015/050160
§ 371 (c)(1),
(2) Date: Sep. 22, 2016

(87) PCT Pub. No.: WO2015/156720
PCT Pub. Date: Oct. 15, 2015

(65) Prior Publication Data

US 2017/0122611 A1 May 4, 2017

(30) Foreign Application Priority Data

Apr. 8, 2014 (SE) ..... 1450434

(51) Int. Cl.
*G05D 15/00* (2006.01)
*G05D 16/00* (2006.01)
(Continued)

(52) U.S. Cl.
CPC ..... *F24F 11/0012* (2013.01); *F24F 1/01* (2013.01); *F24F 3/00* (2013.01); *F24F 5/0092* (2013.01);
(Continued)

(58) Field of Classification Search
CPC .. F24F 11/0012; F24F 1/01; F24F 3/00; F24F 5/0092; F24F 11/001; F24F 11/0017;
(Continued)

(56) References Cited

U.S. PATENT DOCUMENTS

2005/0006488 A1* 1/2005 Stanimirovic ..... F24F 11/0086 236/49.1
2010/0307733 A1* 12/2010 Karamanos ..... F24F 11/006 165/254
(Continued)

FOREIGN PATENT DOCUMENTS

WO 2007/079434 A2 7/2007
WO 2008/115138 A1 9/2008
WO 2011/040853 A1 4/2011

OTHER PUBLICATIONS

International Search Report Corresponding to PCT/SE2015/050160 dated Jul. 23, 2015.
(Continued)

*Primary Examiner* — Justin Jonaitis
(74) *Attorney, Agent, or Firm* — Davis & Bujold PLLC; Michael J. Bujold

(57) ABSTRACT

Method and air treatment device (1) for control of supply air flow (L1). The air treatment device (1) comprises a chilled beam (2) with a pressure box (5) comprising an inlet (6) for inflow of supply air flow (L1) and a plurality of outlets (7) for outflow of the supply air flow (L1) out of the pressure box (5). The air treatment device (1) comprises an actuator (12) for control of supply air flow (L1), and the pressure box (5) comprises at least one pressure measuring socket (13) for control of static pressure (ps). The air treatment device (1) registers the static pressure (ps) and the position of the actuator (12), and calculates the real supply air flow (L1). The actuator (12) is arranged to change the configuration of
(Continued)

Figure 1:
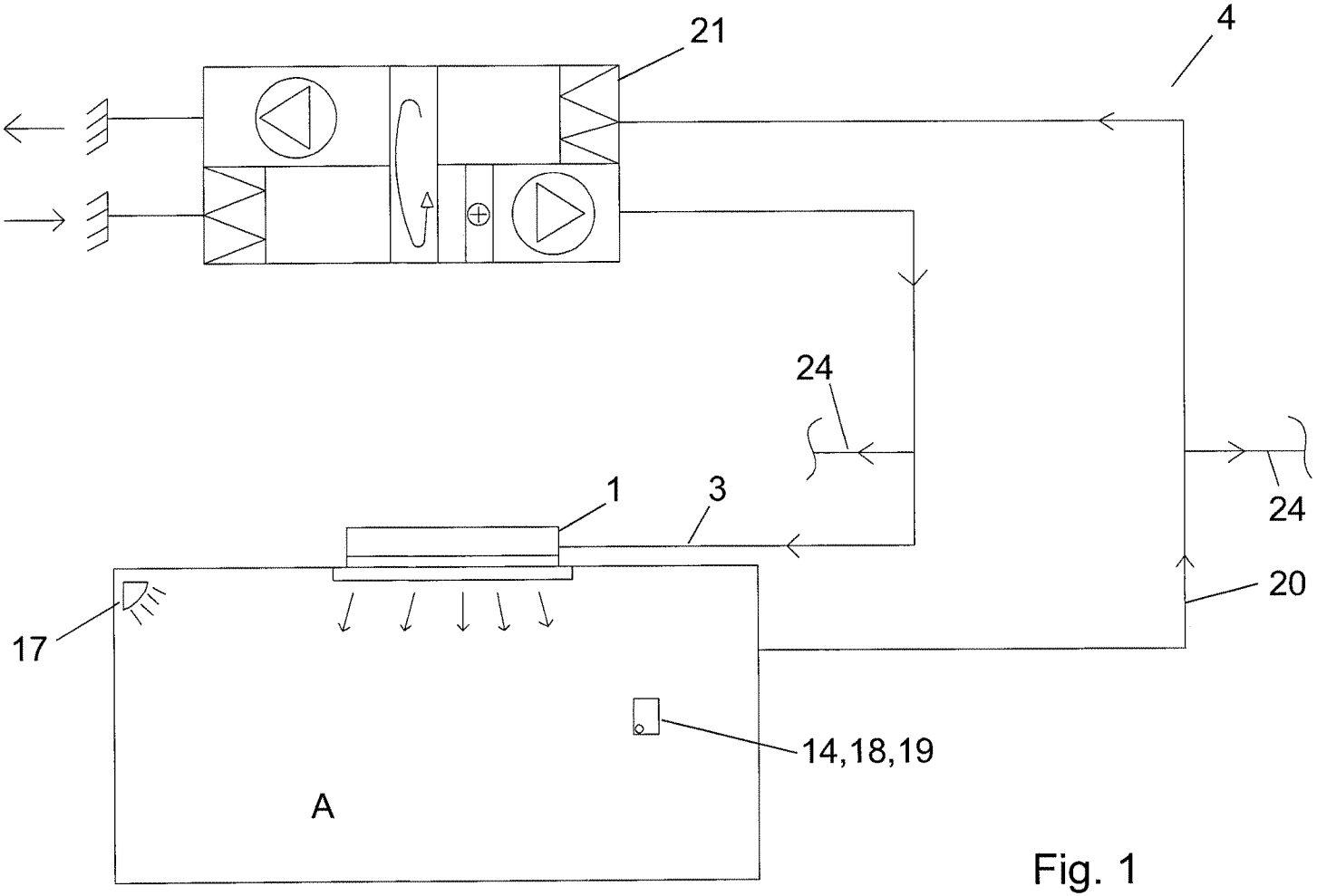

the outlets (7) by a linear motion of a cover member (9) and change the open area of the outlets (7).

5 Claims, 3 Drawing Sheets

(51) Int. Cl.

| | |
|---|---|
| ***G05D 23/00*** | (2006.01) |
| ***F24F 11/00*** | (2018.01) |
| ***F24F 1/01*** | (2011.01) |
| ***F24F 5/00*** | (2006.01) |
| ***F24F 13/12*** | (2006.01) |
| ***F24F 3/00*** | (2006.01) |

(52) U.S. Cl.
CPC ..... *F24F 11/001* (2013.01); *F24F 11/0017* (2013.01); *F24F 11/0034* (2013.01); *F24F 11/0076* (2013.01); *F24F 13/12* (2013.01); *F24F 2003/003* (2013.01); *F24F 2011/0026* (2013.01); *F24F 2011/0042* (2013.01)

(58) Field of Classification Search
CPC .... F24F 11/0034; F24F 11/0076; F24F 13/12; F24F 2003/003; F24F 2011/0026
USPC ..... 165/279
See application file for complete search history.

(56) References Cited

U.S. PATENT DOCUMENTS

2017/0205088 A1* 7/2017 Fischer ..... F24F 3/08
2017/0227250 A1* 8/2017 Karamanos ..... F24F 13/0272

OTHER PUBLICATIONS

Written Opinion Corresponding to PCT/SE2015/050160 dated Jul. 23, 2015.

* cited by examiner

DEVICE AND METHOD FOR CONTROLLING A SUPPLY AIR FLOW AT AN AIR TREATMENT SYSTEM

TECHNICAL FIELD

Present invention relates to an apparatus and a method for controlling a supply air flow to a premises and conditioning of the indoor air, by an air treatment device—in particular a so called chilled beam. The air control principal of the air handling system refers to so called VAV-control, which means that the air flow to one or more premises connected to the system is demand controlled, that is, adapted to whether the premises is used or not, and what load prevailing in the room—air flow is variable usually within certain limits.

BACKGROUND OF THE INVENTION

It is well known to use so-called active chilled beams for air supply and simultaneously conditioning room air. By that the supply air is supplied to the chilled beam and further out of the nozzle or nozzles of the beam to the room, an induction flow of room air is created and which is drawn through the chilled beam and an integrated heat exchanger therein. The heat exchanger is liquid connected and cools or heats the air flowing through by heat exchange. Thus the passing air flow circulation is conditioned and the circulation airflow is, after the heat exchanger, mixed with the supply air in a mixing chamber, and the total air flow exiting the premises again. This will make the premises both provided with supply air and simultaneously conditioned.

Furthermore, it is well known in air treatment technology to use VAV (Variable Air Volume), i.e. let either the user control the flow of air to the premises, for example via a push button for forced air flow, or let the system regulate by indication of a presence sensor, CO2 sensor, room temperature sensor, etc., thus controlling the air flow to and from a premises—so-called demand-controlled air flow control. The main reason for this type of control is energy saving and hence reduced operating costs for the plant while it is logical to ventilate and conditioning air only when the demand exists. In several markets, including the Swedish, there are demands for specific minimum air flow for the building's sake, and in Sweden this means an air supply of at least 0.35 l/s, $m^2$. The commercially available VAV solutions are based on that the air handling system comprises a number of damper devices in different parts of the duct system, which regulates the air flow in the respective duct in which the damper device is located. It is also common that these damper devices are provided with an orifice plate for measuring the pressure drop over the flange, thereby enabling calculation of the actual air flow. Usually the plant is divided into sections with such branch dampers for controlling air flow to each branch duct. If one want VAV regulation down to the individual room level, the prior art states that each channel to each room must be provided with such a VAV damper device to ensure that the air flow to the room will be the correct. If one does not use control right down to the room level but collective control, the airflow to a unique room cannot with certainty be controlled/regulated if the air flow demand of the group varies. For example, if the supply air flow demand to some of the meeting rooms in an office space decreases, and these are located in the same group/branch duct, the system will down-regulate the air flow to the group and then also the pressure drop in the air duct is reduced. If then for example one of the meeting rooms is still in use and thus should have normal air flow, it is not certain that this will be the correct/projected air flow because the pressure is not the same as at full load in that group. Thus, it is not certain that the comfort level in the room will be kept. The system is then, at least at room level, pressure-dependent, since a certain pressure is needed before the chilled beam in order to know that it delivers the right amount of air and thereby is able to control the room climate. In order to gain control of the respective rooms thus usually an individual control for each room is installed. The disadvantage of providing the system with individual VAV dampers is that the system gets a built-in and energy consuming pressure drop at each VAV damper. The pressure drop across the orifice must exist and must also not be too low to obtain accuracy in the measurement and control of which current air flow that is present in the duct. In a system with chilled beams coupled to this type of VAV solution is, so to speak, the chilled beam pressure dependent in order to genuinely know that the actual and projected air flow delivered to the room, which is a prerequisite for having control of delivered and desired air volume and delivered cooling effect, as it is dependent of the supply air flow and the induction by the chilled beam at a certain static pressure of the same.

The alternative to reduce the pressure dependence and pressure variation is that for example, build a so-called ring system, which in its ideal form can be exemplified by an office floor where the main supply duct, for example of the supply air, is up-sized and connected to a continuous ring for the entire floor. The duct is dimensioned to always having a low and stable air velocity in the main duct and in that the duct cross section is large, and that each duct branch to each room in principle proceeds directly from the ring duct, the available pressure at each branch in principle gets equal despite some variations in airflow, whereby the air flow for a given demand can be largely met at room level. However, also this solution is based on that the actual air flow delivered out of a single chilled beam or the like is dependent on that the pressure is known and constant. Furthermore, the actual delivered quantity of air still is unknown because no actual registration/measurement is made in the final product/chilled beam. These oversized air ducts require much space, which for example influences the number of floors that can accommodate in a taller building, and also affects other installations that are to share in the installation spaces in the ceiling and vertical shafts. Similarly, a duct system which is not constructed as a ring still have similar characteristics as described above, by that duct dimensions are chosen sufficiently big to get low speed in the ducts, and thereby reduce the pressure dependence in the same manner as in the ring system.

DISCLOSURE OF THE INVENTION

With the now present invention the object is achieved to solve the above problems, from the first aspect of the invention by an air treatment device according to the preamble of claim 1, which is arranged to measure and register the static pressure in the chilled beam pressure box and that the chilled beam is provided with an actuator for controlling the supply air, and that the air treatment device is arranged to register the actuator position. Based on this data, the true/actual air flow into the chilled beam is calculated, and if the state of the premises served by the chilled beam indicates that a change is needed—through the room sensor, the actuator is adjusted whereby the supply air flow changes. Unlike conventional chilled beams with VAV solutions, the outlets/outlet nozzles configuration is changed by using the actuator, and this is based on real flow by measuring the pressure in the chilled beam pressure box. A certain position of the actuator, and thus a certain position on a cover member in relation to the outlets of the pressure box, corresponds to a given configuration of the outlets, such as the size of the outlets, through which the supply air flows. The actuator's position thus corresponds to a so-called k-factor of the outlets; the k-factor is a well-known term within air conditioning. The room sensor or room sensors if several may be, for example presence sensor, temperature sensor or carbon dioxide sensor. The air treatment apparatus of the invention need not by this the above mentioned additional VAV damper to the respective rooms, to really be in control of the individual flows according to conventional technology, but the VAV regulation is done directly on the outlets. Hereby is achieved not only that one actually knows the real flow rates and then may adjust from that, but one also avoids the extra pressure drop caused in each VAV damper and that these dampers must have to achieve certainty of the measurement. The fact that the static pressure is now measured directly in the pressure box and that the VAV function directly affects the outlets/nozzles configuration, a good control of the flow to the individual premises is obtained without unnecessary and energy-consuming pressure drops. According to the preferred embodiment, the actuator is arranged to change the configuration of the outlets by a linear movement of the cover member, whereby the open area of the outlets for outflow of the supply air out of the pressure box changes. Preferably, the outlets are formed as elongated slots which, for example have been punched out of the pressure box side walls. In or outside the respective side walls of the pressure box a cover member is provided, preferably in the form of an elongate strip, also provided with punched elongated slots. By that the actuator is linear and coupled to respective "regulating strip", the regulating strip/the cover member is displaced linearly in relation to the outlets and covers more or less of the outlets open area, when calling for the need of change of the supply airflow. By that the chilled beam performance and the airflow characteristics are tested by laboratory tests according to standard test methods, the so called k-factor is known for various open outlet areas. The k-factor is in this case dynamic, that is, it changes according to a curve, in that the gap area changes continuously. The linear movement of the actuator preferably takes place through a shaft which is moved by the actuator outwardly or inwardly relative to the actuator, which provides the linear movement. The position of the actuator axis corresponds to a particular opening of the gaps which then corresponds to a k-factor. Thus it is possible for the software to calculate the actual air flow based on the actuator position (yielding the k-factor) and the static pressure in the chilled beam pressure box.

Further advantages are that the balancing of the air treatment device additionally can be initiated centrally by a control signal if only the actuator's various outermost positions and any intermediate positions been preset, for example, from the factory. Other advantages are purely installation related when only one product—chilled beam equipped with actuator—needs to be installed instead of the separate installation of chilled beam and VAV damper with various power and control cables to different positions in the ductwork. With the now present invention a pressure-independent chilled beam is achieved, i.e. it delivers the correct air flow regardless of pressure variations within the system—at least within certain reasonable limits (40-120 Pa) and a sufficient measuring pressure for accurate measurement in the pressure box, is also available. Further, the device cope with greater airflow variations than traditional VAV dampers, for example in the order of 1/10 (5-50 l/s) instead of 1/5 (5-25 l/s) depending on that the pressure drop across an orifice plate increases with the square of the pressure, which means that the pressure drops quickly becomes excessively high at too broad span of the air flow.

According to a preferred embodiment of the device is the actuator itself arranged to register the static pressure in the pressure box by that it is provided with a connection for example for a measuring tube, which is connected by one end on this connection and its other end to the pressure box pressure measurement socket. Furthermore, the actuator is adapted to register the actuator position—related to a rotary motion or a linear motion, which means that a certain position of the actuator corresponds to a particular position of the device's cover member, which is movable by the actuator in relation to the outlets. By the cover member covering parts of the outlets area, different configurations of the outlets are obtained, at different positions on the cover member, which is displaced under the influence of the actuator. The actuator according to the embodiment is provided with software which records the information on the actuator position and translates it to a k-factor which, together with the information on the actual static pressure in the chilled beam pressure box, calculates the actual flow through the chilled beam. By the actuator is provided with this "intelligence" and that the actuator according to the invention is arranged directly on the chilled beam, a compact unit is obtained, which moreover can be factory set regarding minimum flow and the control range between normal flow and maximum flow, through preset devices on the actuator, and further a product where the real flow is known. As above, the flow is adjusted if necessary, warranted by the situation in the room via the room sensor, by comparing the actual flow and a set point for the current comfort mode in the room. What is not mentioned above and which apply to all embodiments is, that an integral part of the regulation of the temperature of the room is done by controlling the flow of fluid through the heat exchanger in the chilled beam, according to the conventional technique. The link between the yield of heat exchange and supply air flow is also constantly at hand and increased supply air flow rate generates generally an increased induction flow through the heat exchange and thus an increased heat exchange. For example, if the temperature can't be kept within predetermined values by regulating the flow of liquid and when the liquid flow has reached its maximum, the supply air flow can be increased to increase the induction flow and efficiency of the heat exchange, which is a further advantage by VAV regulation of the flow through the outlets.

In a further preferred embodiment, a pressure sensor is used for recording the static pressure in the pressure box instead of that the actuator registers this. The information about the static pressure is transmitted to the actuator, which on the basis of this and the actuator position calculates the actual flow through the chilled beam. This is an alternative to the closest foregoing embodiment wherein the actuator has a connection for pressure hose. Thereby it is possible to use a simpler actuator if this is preferable.

In an alternative embodiment of the invention is the software, for recording the static pressure in the pressure box and the actuator position, a part of the air treatment system, preferably a part of a BMS-system for controlling the entire plant. It is though not, according to the invention, limited to that the actual "intelligence", which calculates the actual airflow at the chilled beam, is positioned at the air treatment device—the chilled beam—but the software can as well be centralized and global. However, the information gathered, i.e. registered room conditions and current status of the chilled beam including actuator, origins from the "room level".

From a second aspect of the invention the object is achieved to solve the above mentioned problems through a method for controlling the supply air to a premises and for conditioning the same by means of an air treatment device according to the preamble of claim 5, which method comprises the following.

By room sensors positioned in the premises to be served by the air treatment device, the room status is indicated, for example room temperature, carbon dioxide concentration and/or if someone is present in the premises. This is quite conventional technique in which the air treatment system can have different degrees of how advanced the recording of "room conditions", that should be present in each room, should be. For example, the room comfort can be controlled either with respect to temperature or carbon dioxide alternatively both, and in addition also have indication of whether the premises is used by means of occupancy sensors. These types of sensors measuring/registering continuously the state of the room, and depending on the state there are also control sequences to control the system towards a set point that is valid for the current room condition. The control then usually concerns fluid flow through the chilled beam heat exchanger as well as control of airflow to and from the premises. In the now present method also the static pressure in the chilled beam pressure box is measured and recorded and also the position of the actuator, which then corresponds to a certain set of the regulating strip/cover member. The actuators movement affects the regulating strip and thus the configuration of the outlets, for change of supply airflow through the chilled beam. A certain position of the regulating strip corresponds to a certain so-called k-factor, which is then used together with the registered static pressure, whereby the real/actual air flow is calculated. With this the system now knows the real air flow, which is now being compared with the current set point for the current state of the room or the room comfort. If the room conditions indicates that the set point is not reached or that the state is not within set limits regarding, for example, temperature or carbon dioxide, the configuration of the outlets changes, by that the actuator moves the regulating strip/cover member relative to the outlets, whereby the supply airflow changes. The control sequences for how to control can of course look different—for example, when indication of high room temperature, primarily liquid flow through the heat exchanger can be changed, which is a conventional solution. However, if the liquid flow has reached its maximum and still temperature cannot be held, the more supply air can be supplied to the room. The increased supply air flow through the chilled beam is controlled by the actuator and gives in addition to the supply air cooling capacity also increased induction flow through the heat exchanger, which also helps to lower the room temperature—conventional systems do not regulate the outlets configuration. If, instead, the carbon dioxide level is too high, it is in the first place more supply air that is needed, whereby the primary supply air flow is increased. Furthermore, if the premises goes from unoccupied to occupied, which can be indicated by the presence detector or programmed according to scheduled operating time, the system goes from a minimum flow to a normal flow. In normal flow, control is preferably performed on indication of temperature or carbon dioxide. If non-presence, the system regulates the supply air flow down to the minimum flow again. In older solutions similar regulation is performed by means of conventional VAV control with a variety of VAV dampers in the plant for room level control, which costs time both during installation, commissioning and in operation due to pressure drop in each VAV damper. The now present invention measures the static pressure in the chilled beam and the current nozzle configuration and calculates the real/actual airflow to the premises, and changes if necessary the air flow, through the actuator movement, and affects the outlets configuration and hence the chilled beam induction. This refined VAV control, without unnecessary additional pressure drop in the system, is not available in known solutions. In a preferred embodiment of the method, the air flow changes through a linear movement of the cover member, which is displaced in relation to the outlet holes in the chilled beam pressure box, whereby the outlets open area, for the flow of supply air, is increased or decreased. The linear motion is achieved by a linear movement of a shaft disposed at the actuator, which shaft is moved forward or backward relative to the longitudinal extent of the beam. The area change is preferably provided by that the outlets have the form of elongate slots and the cover member likewise, whereby a displacement of the cover member in relation to the outlets allows continuous change of the area from fully open to fully closed and vice versa, while the actuator moves the cover member.

By the invention a number of advantages over known solutions are obtained:

- The real/actual air flow through the chilled beam is in each configuration and occasion known.
- VAV function directly integrated with the chilled beam outlet/nozzles gives that unnecessary pressure loss due to unique VAV damper to the respective chilled beam is avoided, resulting in energy savings and better operating economy.
- Time savings during installation since only one product to install—the chilled beam equipped with VAV—instead of separate VAV dampers and the chilled beam.
- Time savings for balancing because the chilled beam and VAV do not need to be adjusted separately, moreover, it is possible to balance via software through a central control system.
- The chilled beam is pressure independent in respect to known supply air, depending on that the actual static pressure is measured in the chilled beam pressure box and not in another point upstreams in the duct system.
- Handles larger flow area compared with traditional VAV dampers, for example between 5-50 l/s compared to classical VAV where the corresponding values can be for example 5-25 l/s.

SHORT DESCRIPTION OF THE FIGURES

The following schematic principle figures show:

FIG. 1 shows a simplified schematic drawing of an air handling system comprising an air handling unit, supply and exhaust air ducts and the air treatment device connected to the supply air duct and which air treatment device provides a premises with supply air.

Figure 2A:
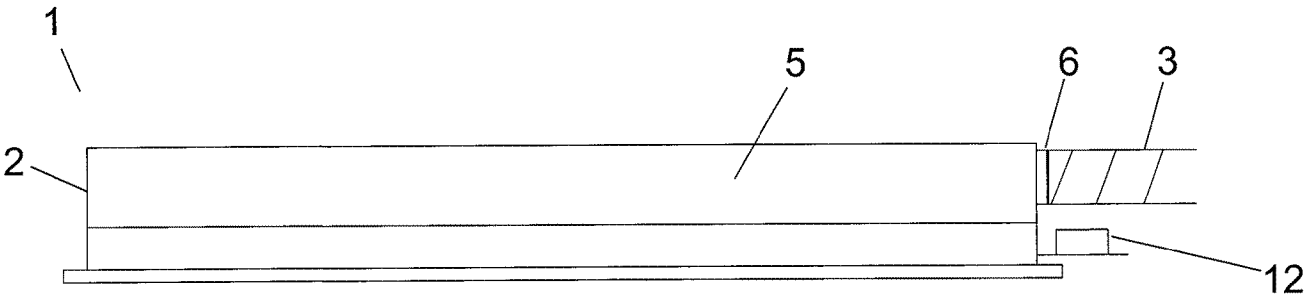

FIG. 2*a* shows a side view of the air treatment device.

Figure 2B:
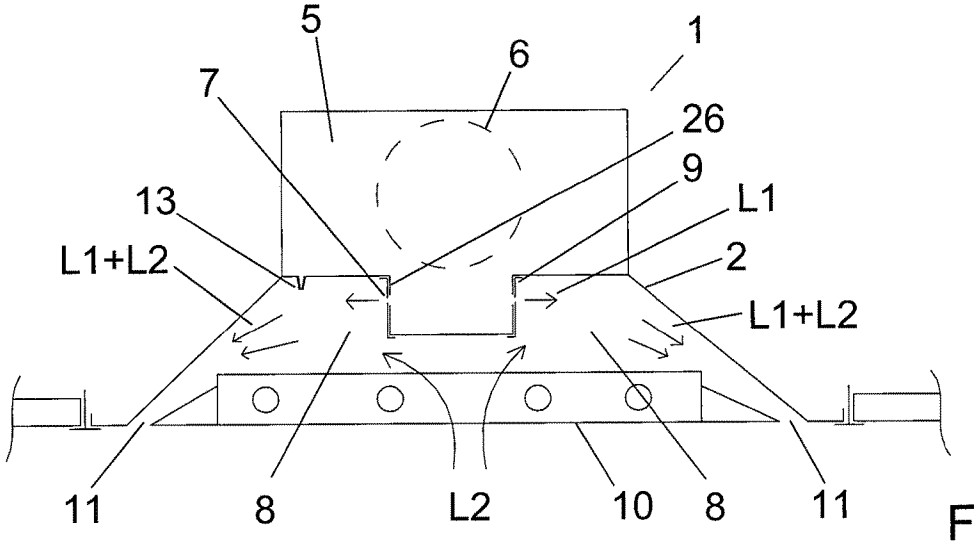

FIG. 2*b* shows a schematic drawing of a section through the air treatment device and the flow of air therethrough.

Figure 3:
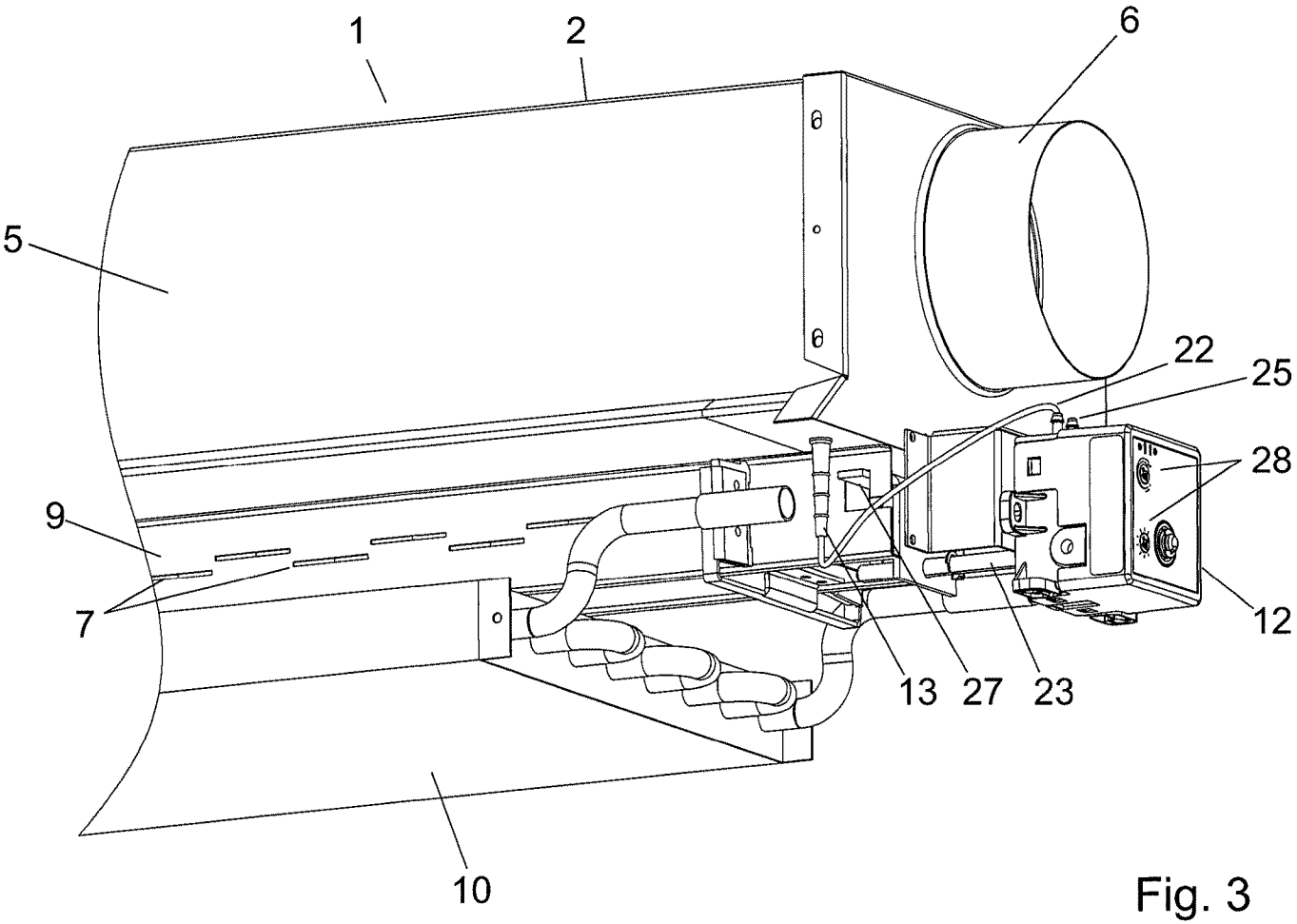

FIG. 3 shows a view obliquely from below of a preferred embodiment of the device.

The structural design of the present invention are apparent in the following detailed description of an embodiment of the invention with reference to the accompanying figures which show a preferred but not limiting embodiment of the invention.

DETAILED DESCRIPTION OF THE FIGURES

FIG. 1 shows a simplified schematic drawing of an air treatment system 4 comprising an air handling unit 21 of conventional type for a VAV-system. The air handling unit 21 is connected to a supply air duct 3 and an exhaust air duct 20 and symbolically is shown that there normally are a number of branch ducts 24 connected to the system. Further, an air treatment device 1 is connected to one end of the supply air duct 3 and the air treatment device 1 provides a premises A with supply air, which is symbolically shown in the figure. In the premises A is a room sensor 14 and a presence sensor 17 provided for the registration of the current condition of the room, for presence or non-presence, room temperature and/or carbon dioxide level. Depending on how the system is intended to be controlled, the room sensor 14 may be in the form of a temperature sensor 18 and/or a carbon dioxide sensor 19. In the figure and subsequent figure descriptions relating to the invention are examples of when the air treatment system 4 comprises presence sensor 17, temperature sensor 18 and carbon dioxide sensor 19, why control of the plant can be based on presence, temperature and carbon dioxide.

FIGS. 2*a* and 2*b* shows a side view through the air treatment device 1, and a section of the same. The air treatment device 1 comprises a chilled beam 2 and a linear actuator 12, which is arranged on the chilled beam 2. The chilled beam 2 is connected to the supply air duct 3 and supply air arrives to the chilled beam pressure box 5 through an inlet 6, preferably at one end of the pressure box 5. The pressure box 5 constitutes a tight enclosure but comprises outlets 7 for the supply air discharge out of the pressure box 5. The outlets 7 are usually punched in one or more of the pressure box 5 wall portions 26—the pressure box often consists of sheet metal. In the pressure box 5 is a static pressure built up, depending on the airflow and the total open area of the outlets 7. In the preferred embodiment, the outlets 7 have the form of elongate slots arranged at regular periodic intervals along in principle the entire longitudinal extent of the pressure box 5, and are arranged to blow out the air in two different directions, essentially perpendicular to the longitudinal extent the chilled beam 2. For change of the outlet 7 open area is a cover member 9 provided, on the outside of the pressure box 5, in a coordinated position with the outlets 7, preferably, one cover member 9 by respective side where the outlets 7 are arranged. The cover member 9 is formed as an elongate strip, and also includes elongated slot openings of corresponding length as the length of the outlet 7. By displacing the cover member 9 back and forth along the longitudinal direction of the pressure box 5, the outlets 7 are more or less covered, or not covered at all, by the cover member 9, as it comprises both covered portions and open gaps. The pressure box 5 also comprises at least one pressure measuring socket 13, representatively disposed for registration of the static pressure in the pressure box 5, and which is adapted for connection of a measuring tube 22, which measuring tube also is connected to a connector 25 on the actuator 12, see FIG. 3. When the supply air discharges out of the pressure box it arrives to a mixing chamber 8. The supply air flow, now referred L1, provides by induction effect a circulating air flow L2, which is the room air which is, through the induction, drawn through a heat exchanger 10, disposed in the chilled beam 2. This heat exchanger 10 is in customary manner liquid connected to a cooling water flow or heating water flow, alternatively both. This is fully conventional technique at chilled beams and in the fluid circuit also control valves are provided to control fluid flow through the heat exchanger 10. The fluid circuit including valves is not shown in the figures. Circulation air flow rate L2 passes through the heat exchanger 10 and becomes conditioned, i.e. cooled or heated, whereupon the air flow arrives to the mixing chamber 8 and joins the supply air flow L1. The common air flow L1+L2 is directed further out of the chilled beam 2 through an elongate outlet opening 11 on the long sides of the chilled beam 2 and further out to the room/premises A.

FIG. 3 shows a view obliquely from below of a preferred embodiment of the air treatment device 1, where some parts have been removed to more clearly show the essential elements of the invention. On the chilled beam 2, the actuator 12 is arranged such that a linear movement of the actuator 12 can be transmitted to the two cover members 9, arranged on a respective wall portion 26 of the of the pressure box 5, see also FIG. 2*b*. In the preferred case, the actuator 12 is provided with a through shaft 23 which is slidably disposed. By that the actuator 12 displaces the shaft 23 along its length direction a linear movement will be accomplished, which movement is transmitted to the cover members 9 through an attachment 27 between the shaft 23 and cover members 9. Further, the actuator 12 is provided with a connection 25 to which one end of a measuring tube 22 is connected. The other end of the measuring tube 22 is connected to the pressure measuring socket 13 on the pressure box 5. The actuator 12 is arranged to register the static pressure in the pressure box 5 and further also adapted to register the physical position of the shaft 23, which position in turn corresponds to a k-factor corresponding with the open area of the outlets 7. Software 15 in the actuator converts the current physical location of the shaft 23 to the current k-factor and calculates the real/actual air flow in the chilled beam 2, by means of the actual static pressure in the pressure box 5. The actuator 12 also has adjustment means 28 in the form of set screws, which are used to set the minimum flow at non-presence, and further for setting within which air flows the supply air flow will vary when presence—from normal flow to maximum flow.

At non-presence in the premises A, indicated by, for example, the presence sensor 17 (see FIG. 1), the air flow is down regulated to minimum flow because the actual air flow in the chilled beam does not match the set point that apply to non-presence. Thus, the actuator 12 displaces the shaft 23 in the direction corresponding to a direction of movement for reduced flow, that is, so that the cover members 9 covers a larger part of the outlets 7, wherein the flow area is decreased. The system regulates the flow so that it is corresponding to the set point flow for non-presence. By that the static pressure and the position of the shaft 23 of the actuator is registered and compared with the set point, the correct supply air to the room is swiftly obtained. Also the fluid flow through the heat exchanger 10 can, depending on the control mode, be adjusted down to a minimum flow. At non-presence it can also be that the temperature and carbon dioxide values may have other limits than at presence mode. At detection of presence or that the temperature or carbon dioxide level is not within the targeted set points, either the flow of liquid or air, or the two in combination, are regulated. Here we discuss only the supply air flow regulation because it is within the scope of the invention. At presence and normal operation mode, the supply airflow is regulated up to a normal operation mode, and if the room temperature rises above the set point value, primarily an adjustment of the liquid flow can be done. But if that is not enough and/or the carbon dioxide level also is too high, the airflow is increased gradually to keep the comfort of the premises. Increased supply air flow L1 out of the pressure box 5 also leads to greater induction, at least up to certain levels, which also means that an increased circulating air flow L2 is drawn up through the heat exchanger 10 and conditioned by it. The actual supply airflow is balanced constantly towards current set point depending on the room condition, and the VAV regulation is individual and direct at the chilled beam 2, without any additional pressure drops beyond that yet available in the chilled beam, and the supply airflow to the premises A is really the correct.

PARTS LIST

1=air treatment device
2=chilled beam
3=supply air duct
4=air treatment system
5=pressure box
6=inlet
7=outlet
8=mixing chamber
9=cover member
10=heat exchanger
11=outlet opening
12=actuator
13=pressure measuring socket
14=room sensor
15=software
16=pressure sensor
17=presence sensor
18=temperature sensor
19=carbon dioxide sensor
20=exhaust air duct
21=air handling unit
22=measuring tube
23=shaft
24=branch duct
25=connector
26=wall portion
27=attachment
28=adjustment means
A=premises
L1=supply air flow
L2=circulation air flow

The invention claimed is:

1. An air treatment device (1) for control of a supply air flow (L1) to a premises (A) and for conditioning of the supply air flow, the air treatment device (1) comprising:

a chilled beam (2) being connected to a supply air duct (3) in an air treatment system (4), the chilled beam (2) comprising a pressure box (5) with at least one inlet (6) for inflow of the supply air flow (L1) from the supply air duct (3) to the pressure box (5), and a plurality of outlets (7) for outflow of the supply air flow (L1) out of the pressure box (5) to a mixing chamber (8), the plurality of outlets (7) being arranged according to a configuration which is changeable by that at least one cover member (9) displaceably arranged in relation to the plurality of outlets (7), the chilled beam (2) comprising at least one liquidly coupled heat exchanger (10) arranged to alternatively cool or heat a through-flowing air stream by heat exchange, through which heat exchanger (10) a circulation air flow (L2) from the premises is arranged to flow (A) due to induction effect driven by the passage of supply air flow (L1) out of the plurality of outlets (7) to the mixing chamber (8), the mixing chamber (8) being arranged to unite the supply air flow (L1) and, via the heat exchanger (10), the conditioned circulation air flow (L2) into a common air stream (L1+L2) and guide the common air stream (L1+L2) to at least one outlet opening (11) for outflow to the premises (A), the air treatment device (1) further comprising at least one actuator (12) for control of a volume flow of the supply air flow (L1), the pressure box (5) comprising at least one pressure measuring socket (13), useful for representative control of static pressure (ps) in the pressure box (5), and the air treatment system (4) comprising at least one room sensor (14), which is arranged to register room conditions in the premises (A) and communicate the room conditions to the air treatment system (4) for control of the air treatment device (1), wherein the air treatment device (1) is arranged to register the static pressure (ps) in the pressure box (5) and a position of the actuator (12) and, based on the static pressure (ps) and the position of the actuator (12), calculate a real supply airflow (L1) in the chilled beam (2), and the actuator (12) is arranged, at an identified need, to change a configuration of the plurality of outlets (7) by a linear motion of the cover member (9) so as to change an open area of the plurality of outlets (7) and change the supply air flow (L1) by displacement of the cover member (9).

2. The air treatment device according to claim 1, wherein the actuator (12) is arranged to register the static pressure (ps) in the pressure box (5) and the position of the actuator (12), and further, based on these, arranged to calculate the real supply airflow (L1) in the chilled beam (2) by software (15) in the actuator (12).

3. The air treatment device according to claim 1, wherein a pressure sensor (16) is arranged to register the static pressure (ps) in the pressure box (5), and the actuator (12) is arranged to, based on that and the position of the actuator (12), calculate the real supply airflow (L1) in the chilled beam (2) by software (15) in the actuator (12).

4. The air treatment device according to claim 1, wherein the air treatment system (4) comprises software (15) for registration of the static pressure (ps) in the pressure box (5) and a position of the actuator (12), and which software (15) is, based on these, arranged to calculate the real supply airflow (L1) in the chilled beam (2).

5. A method for control of supply air flow (L1) to a premises (A) and for conditioning of the supply air flow (L1) by means of an air treatment device (1) which comprises a chilled beam (2) connected to a supply air duct (3) in an air treatment system (4), the chilled beam (2) comprises a pressure box (5) with at least one inlet (6) for inflow of supply air flow (L1) from the supply air duct (3) to the pressure box (5) and a plurality of outlets (7) for outflow of the supply air flow (L1) out of the pressure box (5) to a mixing chamber (8), the plurality of outlets (7) are arranged according to a configuration which is changeable by that at least one cover member (9) which is displaceably arranged relative to the plurality of outlets (7), the chilled beam (2) comprises at least one liquidly coupled heat exchanger (10) arranged to alternatively cool or heat a through-flowing air stream by heat exchange, a circulation air flow (L2) from the premises (A) is arranged to flow due through the heat exchanger (10) to induction effect driven by the passage of supply air flow (L1) out of the plurality of outlets (7) to the mixing chamber (8), the mixing chamber (8) is arranged to unite, via the heat exchanger (10), the supply air flow (L1) and the conditioned, circulation air flow (L2) into a common air stream (L1+L2) and guide the common air stream (L1+L2) to at least one outlet opening (11) for outflow to the premises (A), the air treatment device (1) comprises at least one actuator (12) for control of a volume flow of the supply air flow (L1), and the pressure box (5) comprises at least one pressure measuring socket (13), useful for representative control of static pressure (ps) in the pressure box (5), and the air treatment system (4) comprises at least one room sensor (14), which is arranged to register the room conditions in the premises (A) and communicate the room conditions to the air treatment system (4) for control of the air treatment device (1), the method comprising:

measuring the static pressure (ps) in the pressure box (5), registering the position of the actuator (12) for determining an actual configuration of the plurality of outlets (7) which gives an actual k-factor, calculating the real supply air flow (L1) for the chilled beam (2) based on the static pressure (ps) in the pressure box (5) and the position of the actuator (12), measuring/registering an actual status of the room conditions in the premises (A) by the room sensor (14), comparing the real supply air flow (L1) with a set point for the actual room condition, at a detected need change to a configuration of the plurality of outlets (7), moving the cover member (9) in relation to the plurality of outlets (7) by linear motion of the cover member (9) via the actuator (12), to change the supply air flow (L1) by which motion an open area of the plurality of outlets (7) changes for outflow of supply air flow (L1).

* * * * *